US005951180A

United States Patent [19]

Kawaura

[11] Patent Number: 5,951,180

[45] Date of Patent: Sep. 14, 1999

[54] PRINTING APPARATUS WITH STEP-DRIVEN REVERSIBLE PICKUP-ROLLER

[75] Inventor: Masafumi Kawaura, Nagoya, Japan

[73] Assignee: Brother Kogyo Kabushiki Kaisha, Nagoya, Japan

[21] Appl. No.: 09/017,026

[22] Filed: Feb. 2, 1998

[30] Foreign Application Priority Data

Feb. 5, 1997 [JP] Japan ..... 9-022338

[51] Int. Cl.[6] ..... B41J 11/58

[52] U.S. Cl. ..... 400/629; 271/10.09; 271/113; 271/114; 271/902; 347/104

[58] Field of Search ..... 400/545, 624, 400/625, 629, 634, 636, 641, 618, 617; 271/902, 10.05, 10.09, 161, 242, 113, 114; 347/104

[56] References Cited

U.S. PATENT DOCUMENTS

| | | | |
|---|---|---|---|
| 4,990,011 | 2/1991 | Underwood | 400/636 |
| 5,035,413 | 7/1991 | Yamada et al. | 271/902 |
| 5,725,319 | 3/1998 | Saito et al. | 400/629 |
| 5,775,688 | 7/1998 | Kato et al. | 400/629 |
| 5,775,823 | 7/1998 | Bekki et al. | 400/629 |
| 5,807,003 | 9/1998 | Kobayashi et al. | 400/625 |
| 5,846,006 | 12/1998 | Hirano | 400/624 |
| 5,846,007 | 12/1998 | Narayama | 271/114 |

FOREIGN PATENT DOCUMENTS

| | | |
|---|---|---|
| B2 60-52679 | 11/1985 | Japan . |
| B2 5-10235 | 2/1993 | Japan . |
| B2 2598630 | 1/1997 | Japan . |

*Primary Examiner*—Eugene Eickholt
*Attorney, Agent, or Firm*—Oliff & Berridge, PLC

[57] ABSTRACT

When performing printing by the ink jet head 13, the control unit 78 controls the step motor 75 to rotate counterclockwise by the first number of steps corresponding to the paper feeding quantity of one-line and, after the paper feeding of one-line, to rotate clockwise by the second number of steps smaller than the first number of steps to thereby rotate the paper supply roller 70 clockwise through the middle gear 74 and the driven gear 73, during which the back-tension generated in the paper sheet S is removed. Accordingly, a constant paper feeding quantity can be maintained without regard to the back-tension, providing a stable paper feeding accuracy. Since the back-tension has been removed from the paper sheet S whenever characters and the like are printed on the paper sheet S, in combination of the stable paper feeding accuracy, high printing quality can be obtained without the occurrence of white lines in the printed characters.

10 Claims, 3 Drawing Sheets

PRINTING APPARATUS WITH STEP-DRIVEN REVERSIBLE PICKUP-ROLLER

BACKGROUND OF THE INVENTION

1. Field of the Invention

The present invention relates to a printing apparatus provided with a paper supply unit for supplying paper sheets fed one by one in a predetermined direction by means of a supply roller from a paper accommodating unit such as a hopper, and more particularly to a printing apparatus capable of removing back-tension generated in a paper sheet before printing characters and the like on the paper sheet by a print head while feeding the paper by rotation of a step motor, to maintain a constant paper feeding accuracy and perform printing with high quality.

2. Description of Related Art

Heretofore, there have been proposed various printing apparatuses such as a printer and the like for performing printing of characters and the like by using a print head while feeding paper sheets one by one. In such the printing apparatus, a plurality of paper sheets are generally accommodated in a stack state in a hopper. At the time of printing using the print head, a pick-up roller disposed above the hopper is in contact under pressure to the uppermost positioned paper sheet and feeds only that paper sheet in cooperation with a supply roller toward a printing position where the print head prints characters and the like on the paper sheet.

For a rotating mechanism of the paper supply roller, commonly, a step motor and a gear mechanism which transmits rotational motion of the step motor to the paper supply roller. During printing characters and the like, the printing apparatus alternately conducts an operation of rotating the step motor by predetermined steps in a paper feeding direction to thereby make a rotation of the supply roller by a predetermined paper feeding amount and another operation of performing one-line printing by the print head. At this time, a so-called back-tension is generated in the paper sheet due to the contact under pressure with a collar supported coaxially with the pick-up roller, the backlash generated in the gear mechanism, the bending of roller shafts of rollers of the paper feeding mechanism including a roller shaft of the paper supply roller, the mechanical backlash generated between components. In the above conventional printing apparatus, therefore, a paper feeding is conducted by the paper supply roller rotated by the step motor so as to produce the paper pulling power larger than the back-tension.

As mentioned above, the backlash generated in the gear mechanism, the bending of the roller shafts of rollers of the paper feeding mechanism, and the mechanical backlash generated between components inevitably exist in the printing apparatus; however, the back-tension to be generated in the paper sheet as above has characteristics of being determined based on a balance with the above-mentioned backlash and others. Accordingly, as long as the supply roller is rotated in one direction (the paper feeding direction), the backlash and others are constant. As a result, a constant paper feeding accuracy can be maintained when an operation of rotating the step motor by predetermined steps in the paper feeding direction to rotate the paper supply roller by a predetermined paper feeding amount and another operation of performing one-line printing using the print head on the paper are repeated alternately. This can prevent the occurrence of white lines in printed characters owing to missing print dots.

However, as printing is continued on the paper sheet supplied via the supply roller, the paper sheet is sequentially fed and then is released from the collar supported coaxially with the pick-up roller, when the back-tension having occurred in the paper sheet until then is removed. The supply roller and the print head are positioned apart at a predetermined distance in view of their mechanisms, whereby the print head can conduct printing on the paper sheet even after the back end of the paper sheet is released from the collar. Removal of the back-tension generated in the paper sheet causes the unbalance between the back-tension and the backlash occurring in the gear mechanism and others, so that the force caused by the backlash and the others acts on the paper sheet in the paper feeding direction, thus deteriorating the paper feeding accuracy. Accordingly, the paper sheet is fed more than necessity, causing white lines in characters printed on the paper sheet and therefore deteriorating printing quality.

SUMMARY OF THE INVENTION

The present invention has been made in view of the above circumstances and has an object to overcome the above problems and to provide a printing apparatus capable of removing the back-tension generated in the paper sheet before printing using a print head on the paper sheet while driving a step motor to rotate a paper supply roller to thereby feed the paper sheet, whereby a constant paper feeding accuracy can be maintained and thus printing of characters and the like can be performed with high printing quality.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a printing apparatus in one aspect of this invention comprises a paper accommodating unit for accommodating stacked paper sheets, a paper supply roller for feeding a paper sheet from the paper accommodating unit in a predetermined feeding direction, a mechanism for generating tension in the paper sheet fed by the paper supply roller, a driving motor for rotating the paper supply roller, a print head for performing printing on the paper sheet fed by the paper supply roller, and a control unit for controlling the driving motor to rotate by a first rotation quantity in the feeding direction to feed the paper sheet and, after that, by a second rotation quantity which is smaller than the first rotation quantity in a reverse direction to the feeding direction to remove the tension generated in the paper sheet by the tension generating mechanism.

In the printing apparatus of the invention, under control by the control unit, the driving motor is rotated by the first rotation quantity in the paper feeding direction to advance a paper sheet and then it is rotated by the second rotation quantity in the reverse direction to the paper feeding direction, so that the tension generated in the paper sheet through the tension generating mechanism can be removed. Since the rotation of the driving motor is controlled by the control unit, the paper feeding quantity can be maintained uniformly without regard to the tension caused by the tension generating mechanism, which makes it possible to obtain a constant paper feeding accuracy. Furthermore, characters and the like are printed on the paper sheet after the tension has been removed therefrom, so that printing quality can effectively obtained without the generation of white lines on the printed characters and the like.

According to another aspect of the invention, there is provided a printing apparatus comprising, a hopper for accommodating stacked paper sheets, a pick-up roller which comes into contact under pressure with a paper accommodated in the hopper to pick up the paper sheet, a paper supply roller for feeding the paper sheet picked up by the pick-up roller in a predetermined feeding direction, a tension generating mechanism for generating tension in the paper sheet fed by the paper supply roller, a step motor for rotating the paper supply roller, a print head for performing printing on the paper sheet fed by the paper supply roller, and a control unit for controlling the step motor to rotate by a first number of steps in the paper feeding direction to feed the paper sheet and, after that, to rotate by a second number of steps smaller than the first number of steps in a reverse direction to the paper feeding direction, thereby to remove the tension generated in the paper sheet by the tension generating mechanism.

When the printing apparatus of the invention performs printing of characters and the like on a paper sheet, after the paper sheet is picked up by the pick-up roller from the hopper, the control unit controls the rotation of the step motor to rotate the paper supply roller to thereby feed the paper sheet in a predetermined direction, and the print head to print characters and the like on the paper sheet. During printing characters, the control unit drives first the step motor to rotate by the first number of steps (the first rotation quantity) to feed the paper sheet in the paper feeding direction. At this time, the back-tension is generated in the paper sheet due to the pressing by the collar supported coaxially with the pick-up roller or the backlash generated in the gear mechanism and the like. After that The control unit rotates the step motor in the reverse direction to the paper feeding direction by the second number of steps (the second rotation quantity) which is smaller than the first number of steps, so that the back-tension generated in the paper sheet is removed. The print head then prints characters and the like on the paper sheet.

As mentioned above, based on the control of rotation of the step motor by the control unit, a constant paper feeding quantity can be kept without the influence of the back-tension, providing a stable paper feeding accuracy. Since characters and the like are printed on the paper sheet after the back-tension has been removed, in combination of the stable paper feeding accuracy, high printing quality can be obtained without generation of white line in the characters printed on the paper sheet.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

Figure 1:
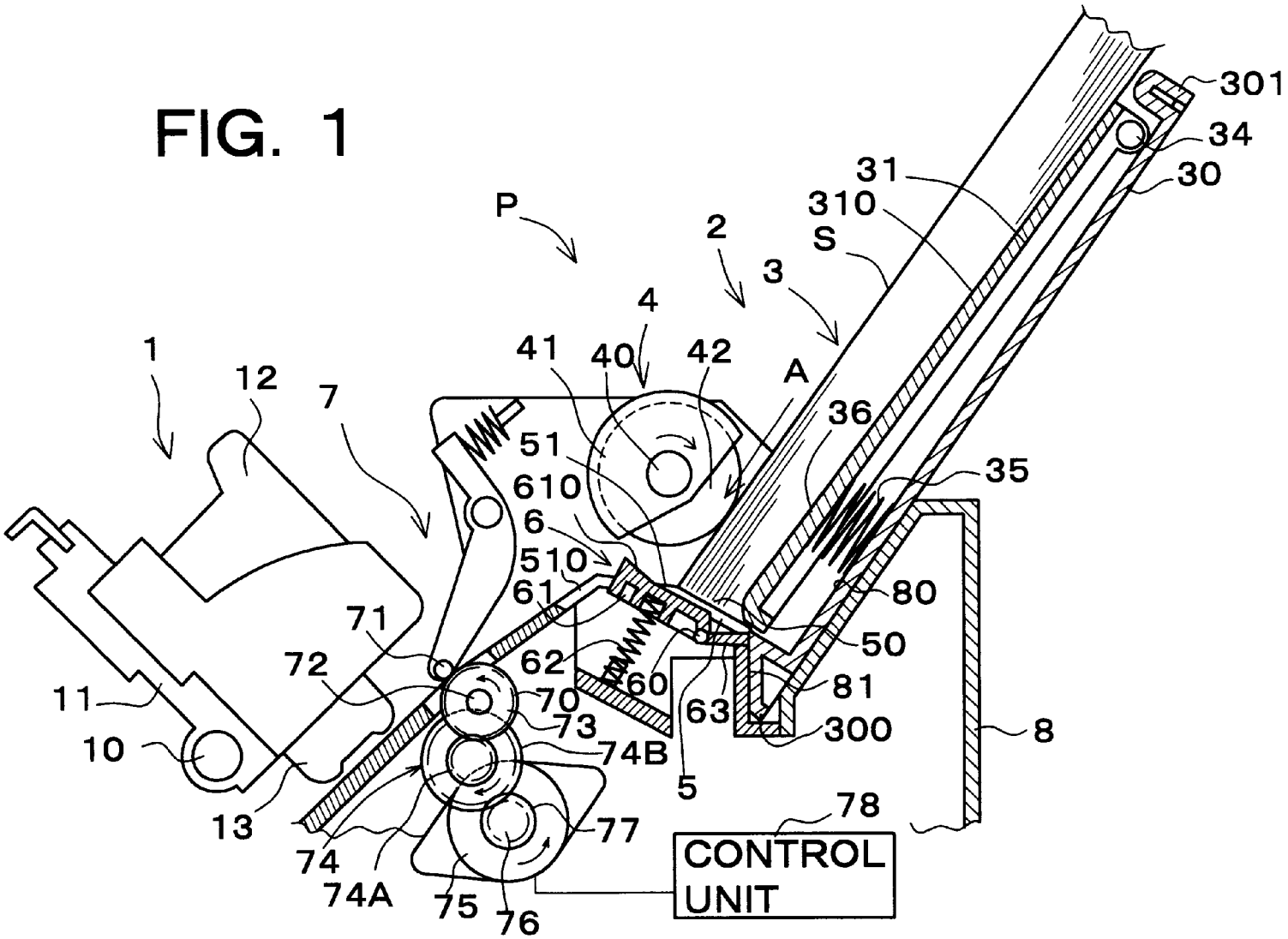
FIG. 1 is a sectional view of an ink jet printer in an embodiment according to the invention.

A detailed description of a preferred embodiment of an ink jet printer embodying a printing apparatus of the present invention will now be given referring to the accompanying drawings. First, a schematic construction of an ink jet printer P is explained with reference to FIG. 1. FIG. 1 is a sectional view of the ink jet printer.

In FIG. 1, the ink jet printer P is provided with a printing mechanism 1 for printing predetermined characters and the like on a paper sheet S and a paper supply unit 2 for supplying paper sheets S one by one to the printing mechanism 1. Each of the paper sheets S is in a rectangular form having a predetermined size, i.e., a so-called cutform paper sheet.

The printing mechanism 1 is provided with a carriage 11 which makes a reciprocating motion along a guide rail 10, an ink cartridge 12 and an ink jet head 13 which are supported on the carriage 11. The guide rail 10 is disposed in a width direction of the paper sheet S to be supplied from the paper supply unit 2, in other words, in the direction parallel to the surface of the paper sheet S and orthogonal to the feeding direction of the paper sheet S indicated by an arrow A in FIG. 1. At the time of printing, the carriage 11 is driven to reciprocate by a carriage driving motor 163 (see FIG. 2) and the ink jet head 13 ejects ink droplets onto the paper sheet S passing below the head 13, whereby characters, figures, and the like are printed on the paper sheet S. It is noted that the feeding direction of the sheet S is determined according to the structure defining a feeding path of the sheet S and, in FIG. 1, it is represented by a direction along which the paper sheet S is transported from the hopper 3, namely, the direction of the arrow A. Unless a notice, the feeding direction mentioned below also indicates the direction of the arrow A in FIG. 1.

The paper supply unit 2 is provided with a hopper 3 for accommodating stacked paper sheets S, a feeding mechanism 4 for feeding paper sheets one by one from the hopper 3, a wall plate 5 which the leading end of the paper sheet S to be fed from the hopper 3 is in contact with, a stopper mechanism 6 provided in the wall plate 5, and a paper supply mechanism 7 for transporting the paper sheet S just under the ink jet head 13 arranged ahead of the wall plate 5 in the feeding direction of the paper sheet S.

The hopper 3 comprises a paper supply cassette 30 removably to the printer. This cassette 30 is supported on cassette receiving portions 80 and 81 formed in a printer frame 8 so that an end portion 300 of the cassette 30, i.e., a paper discharging end, be positioned downward. In the inside of the cassette 30 is provided a pressing plate 31, on an upper surface 310 of which the paper sheets S are stacked.

The pressing plate 31 is rotatably about a rotating axis 34 provided near a rear end 301 of the paper supply cassette 30, and is always biased toward the feeding mechanism 4 side by a spring 35, pushing the leading end side of the paper sheet S upward. It is noted that the rotating axis 34 is disposed parallel to the width direction of the paper sheet S. The pressing plate 31 is made of material such as resin, and its upper surface 310 where the material appears has a relatively small coefficiency of friction. Compared with the friction resistance between the stacked sheets S, accordingly, the friction resistance between the lowermost positioned sheet S within the hopper 3 and the upper surface 310 of the pressing plate 31 is small. In case of a small number of paper sheets S (for example, two or three sheets), there is a possible that all of the paper sheets S may slip along the upper surface 310 of the pressing plate 31 to be fed all at once. To avoid it, a friction member 36 for keeping the lowermost positioned sheet S in the hopper 3 is provided on the surface 310 of the pressing plate 31. For example, cork is used for the friction member 36.

Furthermore, the feeding mechanism 4 comprises a support shaft 40 parallel to the width direction of the paper sheet S, a pair of pick-up rollers 41, only one of which is shown in FIG. 1, attached on the support shaft 40 at an interval, and a collar 42. The support shaft 40 is rotatable in at least a clockwise direction in FIG. 1 by a driving power source not illustrated.

The collar 42 is formed in the shape of a circular plate having an outer periphery of a constant curvature and is rotatable with respect to the support shaft 40. An outer diameter of the collar 42 is set to be slightly smaller than that of the circular portion of the pick-up roller 41, so that the outer periphery of the collar 42 is positioned inward than that of the pick-up roller 41 in a radius direction. When the support shaft 40 is rotated clockwise in FIG. 1, making the circular portion of the pick-up roller 41 face to the hopper 3, the uppermost sheet of the paper sheets S pushed upward by the pressing plate 31 is pressed to the outer periphery of the pick-up roller 41 and is transported from the hopper 3 in the feeding direction by the rotation of the pick-up roller 41. When the pick-up roller 41 is further rotated and then held apart from the paper sheet S, a part of the paper sheet S remaining within the hopper 3 comes into contact with the collar 42. Upon completion of the paper feeding by means of the pick-up roller 41, the collar 42 is thus rotated by the paper sheet S being sequentially transported by the paper supply mechanism 7. Until the next sheet S is started to be transported, the collar 42 serves to prevent the floating of the next sheet S, thereby preventing a double feeding where two or more sheets S are transported as overlaid owing to the floating of the next sheet S.

When the collar 42 is in contact with the paper sheet S, the paper sheet S is pressed by the collar 42 in combination with the biasing force of the spring 35 disposed under the pressing plate 31. The paper sheet S as pressed is transported toward the ink jet head 13 by means of a paper supply roller 70 and a follower 71. At this time, back-tension is generated in the paper sheet S due to the friction between the paper sheet S and the collar 42.

As shown in FIG. 1, the wall plate 5 is integrally formed with the printer frame 8 and is provided with a paper receiving portion 50 for receiving the paper sheets S positioned downward toward the end of the cassette 30 and an inclined portion 51 formed extending upward from the receiving portion 50 and inclining toward the paper feeding direction as apart from the cassette 30. The paper sheet S fed out of the cassette 30 is transported over the wall plate 5 toward the paper supply mechanism 7 side. In the inclined portion 51 is formed a through hole (not shown) in which the stopper mechanism 6 is disposed. The inclined portion 51 may be curved or provided on its surface with a protrusion extending in the paper feeding direction. In the case of a protrusion, the shape of the inclined portion 51 is defined by the upper surface of the protrusion.

The stopper mechanism 6 is constructed of a stopper 61 rotatably about a rotating axis 60 provided parallel to the width direction of the paper sheet S in the bottom side of the hopper 3, a coil spring 62 for biasing the stopper 61 to protrude through the through hole from the inclined portion 51 toward the hopper 3 side, and an arm 63 integrally formed with the stopper 61. By the contact of the arm 63 with a side end of the through hole, the maximum protruded position of the stopper 61 is defined. The rotating axis 60 and the coil spring 62 are supported on the frame 8. The stopper 61 is provided with a contact surface 610 which comes into contact with the paper sheet S. When the stopper 61 is protruded from the inclined portion 51, the contact surface 610 has a sharper slope than the inclined portion 51 with respect to the paper feeding direction.

The stopper 61 is formed of resin as well as the printer frame 8, whose rigidity is set to be large so as to hold the uniform shape against the force of the paper sheets S pressing the contact surface 610 in a contact state. The pressing force of the coil spring 62 with respect to the stopper 61 is set so that the stopper 61 be protruded from the inclined portion 51 according to the rigidity of the paper sheets S, whereby appropriate separating efficiency according to the rigidity of the paper sheet S can be obtained.

More specifically, if the paper sheet S having large rigidity, for example, thick paper such as cards or envelops, pushes the contact surface, the stopper 61 is pushed down up to being substantially flush with the inclined portion 51 whereby the leading end of the paper sheet S slips along the inclined portion 51 to be transported out of the hopper 3. At this time, even when a plurality of paper sheets S are transported at the same time out of the hopper 3, those sheets S will come into contact with the inclined portion 51 and can be easily separated individually by being bent along the inclined portion 51. As a result thereof, only the uppermost positioned sheet S is pushed by the pick-up roller 41 to get over the inclined portion 51. On the other hand, when the paper sheets S each being thin and small in rigidity pushes the stopper 61, the spring 62 is not practically compressed by such the paper sheets S, allowing the stopper 61 to protrude from the inclined portion 51. The paper sheet S is thus transported out of the hopper 3 so as to get over the stopper 61. In this case, the leading end of the paper sheet S is largely bent as compared with the former case where the stopper 61 is pushed down below the inclined portion 51, so that the paper sheet S having small rigidity can also be separated individually and the lower positioned paper sheets S can be more firmly held by the stopper 61 than the uppermost positioned paper sheet S.

Since the paper sheet S having small rigidity is separated by only the stopper 61 as above, it is sufficient that the inclination of the inclined portion 51 is set so as to provide an appropriate separating operation with respect to the paper sheet S having large rigidity. Accordingly, any types of paper sheets S can be separated individually regardless of the degree of rigidity. Note that, if the inclination of the inclined portion 51 is set to be large according to the small rigidity of a paper sheet S, there is a possibility that a different paper sheet S having large rigidity can not go over the inclined portion 51 and thus the paper sheet S is stopped as held within the hopper 3, causing idling of the pick-up roller 41.

The paper sheet S having gone over the wall plate 5 is introduced between the paper supply roller 70 and the follower 71 of the paper supply mechanism 7. The roller 70 is driven to rotate clockwise in FIG. 1 until the paper sheet S is transported by a predetermined length by the pick-up roller 41 and then rotate counterclockwise. The paper sheet S is transported toward the printing mechanism 1 side as the leading end of the paper sheet S is arranged in an axial direction of the roller 70.

In the paper supply mechanism 7, a driven gear 73 is fixed to a roller shaft 72 of the paper supply roller 70. This driven gear 73 is engaged with a small diameter gear 74A of a middle gear 74. A larger diameter gear 74B of the middle gear 74 is engaged with a driving gear 77 fixed to a driving shaft 76 of the step motor 75. This step motor 75 is controlled by a control unit 78 to rotate.

Figure 2:
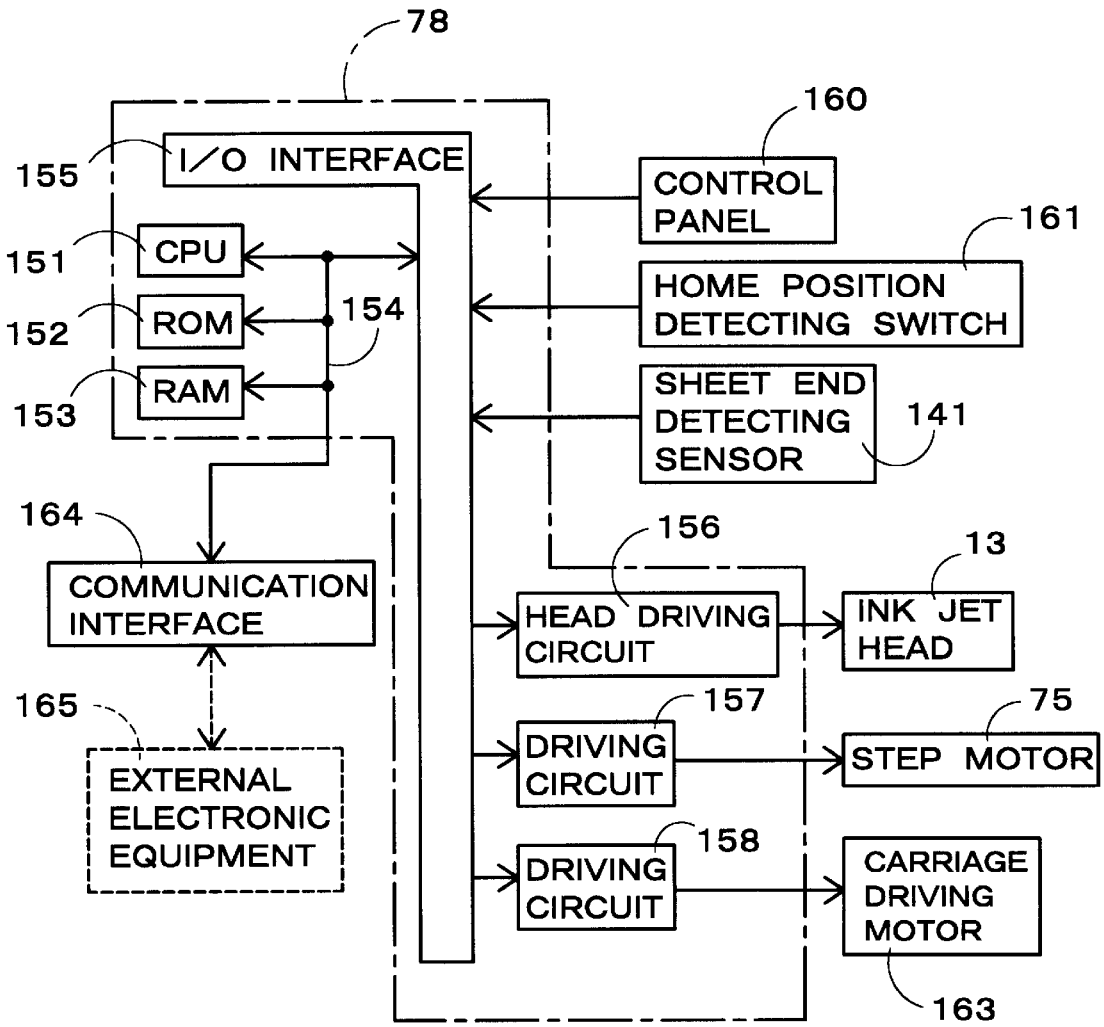
FIG. 2 is a block diagram of a control system of the ink jet printer.

Next, a control system of the ink jet printer P will be explained with reference to FIG. 2. FIG. 2 is a block diagram showing the control system of the ink jet printer P. In FIG. 2, the control unit 78 comprises a CPU 151, a ROM 152 and a RAM 153 both connected through a bus 154 such as a data bus and the like to the CPU 151, an input/output (I/O) interface 155, and driving circuits 156, 157, and 158 each connected to the I/O interface 155.

To the I/O interface 155 are connected a control panel 160 provided with a power switch, other switches, and a display lamp, a switch 161 for detecting a home position of the carriage 11, and a sensor 141 for detecting an end of a paper sheet S when released from the collar 42. The ink jet head 13 is connected to the head driving circuit 157. The step motor 75 is connected to the driving circuit 157. The carriage driving motor 163 is connected to the driving circuit 158. Furthermore, the control unit 78 can receive recording data transmitted through a communication interface 164 connected with the bus 154 from an external electronic equipment 165.

The ROM 152 stores a communication control program to receive the recording data transmitted from the external electronic equipment 165, a printing control program to drive the ink jet head 13, the carriage driving motor 163, and the step motor 75 and the like in accordance with printing data developed into dot pattern data. The RAM 153 includes a memory for storing the received recording data, a memory for storing the printing data, and also other memories and buffers needed for communication control and printing control.

Explanation is made in relation to the control operation of the control unit 78 in the ink jet printer P constructed as above to rotate the step motor 75 during a printing operation using the ink jet head 13 to print characters and the like on the paper sheet S.

First, the pick-up roller 41 is driven to rotate clockwise by a driving power source not illustrated to feed the uppermost positioned sheet S of the stacked sheets accommodated in the hopper 3. The paper sheet S is picked up and separated from other paper sheets remaining in the hopper 3 through the wall plate 5 and the stopper mechanism 6 and others, and it is transported to a nip point of the roller 70 and the driven roller 71 of the paper supply mechanism 7. When the paper sheet S is transported further forward where the paper sheet S is subjected to a so-called resist operation, the pick-up roller 41 does not come into contact with the paper sheet S and, instead thereof, the collar 42 comes into contact with the paper sheet S. Until then, the step motor 75 is driven to rotate clockwise to rotate the paper supply roller 70 clockwise as mentioned above.

After that, the step motor 75 is driven by the control unit 78 to rotate counterclockwise to rotate the paper supply roller 70 counterclockwise through the middle gear 74. The counterclockwise rotation of the roller 70 makes the transportation of the paper sheet S toward the ink jet head 13, furthermore, up to a predetermined printing start position over the ink jet head 13.

At this time, the paper sheet S is in contact under pressure with the collar 42 by the biasing force of the spring 35 disposed under the pressing plate 31. When the paper sheet S as held in such the state is transported through the paper supply roller 70 and the driven roller 71 toward the ink jet head 13, back-tension due to the friction between the paper sheet S and the collar 42 is generated in the paper sheet S. In this sheet S, back-tension is similarly generated in the reverse direction to the paper feeding direction due to the backlash generated in the gear mechanism (gears 76, 74B, 74A, and 73), the bending of roller shafts of rollers in the paper supply mechanism 7 including the roller shaft 72 of the roller 70, and the mechanical backlash generated between components. The back-tension balances with the above backlash generated in the gear mechanism (gears 76, 74B, 74A, and 73), the bending of roller shafts of rollers in the paper supply mechanism 7, and the mechanical backlash generated between components.

To remove the back-tension, the step motor 75 is driven by the control unit 78 to rotate clockwise by the second number of steps (the second rotation quantity) needed for removing the back-tension. For example, the control unit 78 outputs a driving signal of three pulses to a pulse motor (75) to rotate same by three steps (the second number of steps) in a clockwise direction.

The clockwise rotation of the step motor 75 by the second number of steps causes the clockwise rotation of the paper supply roller 70 through the middle gear 74 and the driven gear 73. By this clockwise rotation of the roller 70, the back-tension generated in the paper sheet S is removed. As a result, no back-tension exists in the paper sheet S at this time. On the paper sheet S, the ink jet head 13 begins to eject ink droplets to perform one-line printing of characters and the like.

Upon completion of one-line printing by the ink jet head 13, the control unit 78 drives the step motor 75 to rotate counterclockwise by the first number of steps (the first rotation quantity) corresponding to the number obtained by adding the second number of steps to the number of steps corresponding to the paper feeding quantity of one line. For example, if the paper feeding quantity of one line corresponds to forty-two steps, the control unit 78 outputs a driving signal of forty-five (42+3=45) pulses to the pulse motor 75. The pulse motor 75 is thus rotated counterclockwise by forty-five steps (the first number of steps). Accordingly, the paper supply roller 70 is rotated counterclockwise through the middle gear 74 and the driven gear 73 to feed the paper sheet S by the quantity corresponding to one-line. The back-tension remains in the paper sheet S at this time.

After one-line feeding of the paper sheet, the control unit 78 drives the step motor 75 to rotate clockwise again by the second steps. This means that the step motor 75 is rotated in the paper feeding direction by the number of steps (42 steps) obtained by subtracting the second number of steps (3 steps) from the first number of steps (45 steps). The paper feeding quantity of one-line of the paper sheet S thus equals to the quantity corresponding to the number of steps (42 steps) obtained by subtracting the second number from the first number of steps. The clockwise rotation of the step motor 75 based on the second number of steps causes the clockwise direction of the paper supply roller 70 through the middle gear 74 and the driven gear 73. This clockwise rotation of the supply roller 70 removes the back-tension generated in the paper sheet S. As a result, no back-tension exists in the paper sheet S at this time. On that paper sheet S, the ink jet head 13 performs again printing by one-line.

The control unit 78 drives the step motor 75 every one-line printing through the ink jet head 13 to rotate counterclockwise by the first number of steps and then clockwise by the second number of steps. Thus, at every one-line printing operations, the operation to transport the paper sheet S by one-line by the forward rotation of the paper supply roller 70 and the other operation to remove back-tension generated in the paper sheet S by the reverse rotation of the roller 70 are conducted. This makes it possible to always maintain the constant feeding quantity of the paper sheet S without the influence of back-tension generated in the paper sheet S when the ink jet head 13 performs printing on the paper sheet S, enabling to keep a stable paper feeding accuracy.

Furthermore, since characters and the like are printed on the paper sheet S after the back-tension has been removed, in addition to the stable paper feeding accuracy, high printing quality can be obtained without the occurrence of white lines and like in the printed characters.

As mentioned above, under control by the control unit 78, when the paper one-line feeding operation and the back-tension removing operation conducted by the paper supply roller 70 through the step motor 75 and the one-line printing operation by the ink jet head 13 are repeated to continuously perform printing of characters and the like on the paper sheet S, the collar 42 comes to press near the back end of the paper sheet S and does not press the paper sheet S on releasing the back end of the paper sheet S. At this time, the back-tension having been generated in the paper sheet S is removed. In the ink jet printer P in the embodiment, the paper supply roller 70 is reversely rotated by a small quantity every time after the paper sheet S is transported by one-line by the paper supply roller 70, so that the feeding quantity of the paper sheet S is uniformly maintained without change in the paper feeding accuracy.

In the ink jet printer P in the embodiment mentioned above, when the ink jet head 13 performs printing, the step motor 75 is driven by the control unit 78 to rotate counterclockwise by the first number of steps which is obtained by adding the second number of steps to the number corresponding to the one-line paper feeding quantity and, after the one-line paper feeding operation, to rotate clockwise by the second number of steps which is smaller than the first number of steps whereby the paper supply roller 70 is rotated clockwise through the middle gear 74 and the driven gear 73. During the clockwise rotation of the roller 70, the back-tension generated in the paper sheet S is removed. Therefore, a constant feeding quantity of the paper sheet S can be maintained without the influence of the back-tension, thus enabling to keep a stable paper feeding accuracy. Since characters and the like can be always printed on the paper sheet S after the back-tension has been removed, in addition to the constant paper feeding accuracy, high printing quality without the occurrence of white lines in the printed characters can be achieved.

Furthermore, every time when the ink jet head 13 performs the one-line printing, the counterclockwise rotation of the step motor 75 by the first number of steps and the clockwise rotation of the same by the second number of steps are conducted under control by the control unit 78. Characters and the like of one-line are thus printed on the paper sheet after the back-tension has been removed from the paper sheet, which prevents white lines from occurring in the printed characters, and resulting in high printing quality.

The present invention may be embodied in other specific forms without departing from the spirit or essential characteristics thereof. For instance, although the first number of steps is set to forty-five steps and the second number of steps to three steps in the above embodiment, those numbers of steps can be optionally selected according to the type of an ink jet printer P.

In the above embodiment, the one-line printing is completed through one running of the carriage 11 mounting the ink jet head 13; however, it may be completed through plural runnings (plural passes) of the carriage, namely, a so-called interlace printing. In the interlace printing, specifically, the step motor 75 is rotated counterclockwise by the first number of steps obtained by adding the second number of steps to the number corresponding to the paper feeding quantity every pass, and then is rotated clockwise by the second number of steps. Thus, a printing operation every pass can be performed on the paper sheet S in the state where the back-tension has been removed. If the paper feeding quantity of each pass, for example, the paper feeding quantity after the first pass printing and that after the second pass printing are not equal, the first number of steps may be changed according to the difference therebetween. This makes it possible to perform the interlace printing with high accuracy without dislocation of dot pitch in the paper feeding direction.

Figure 3:
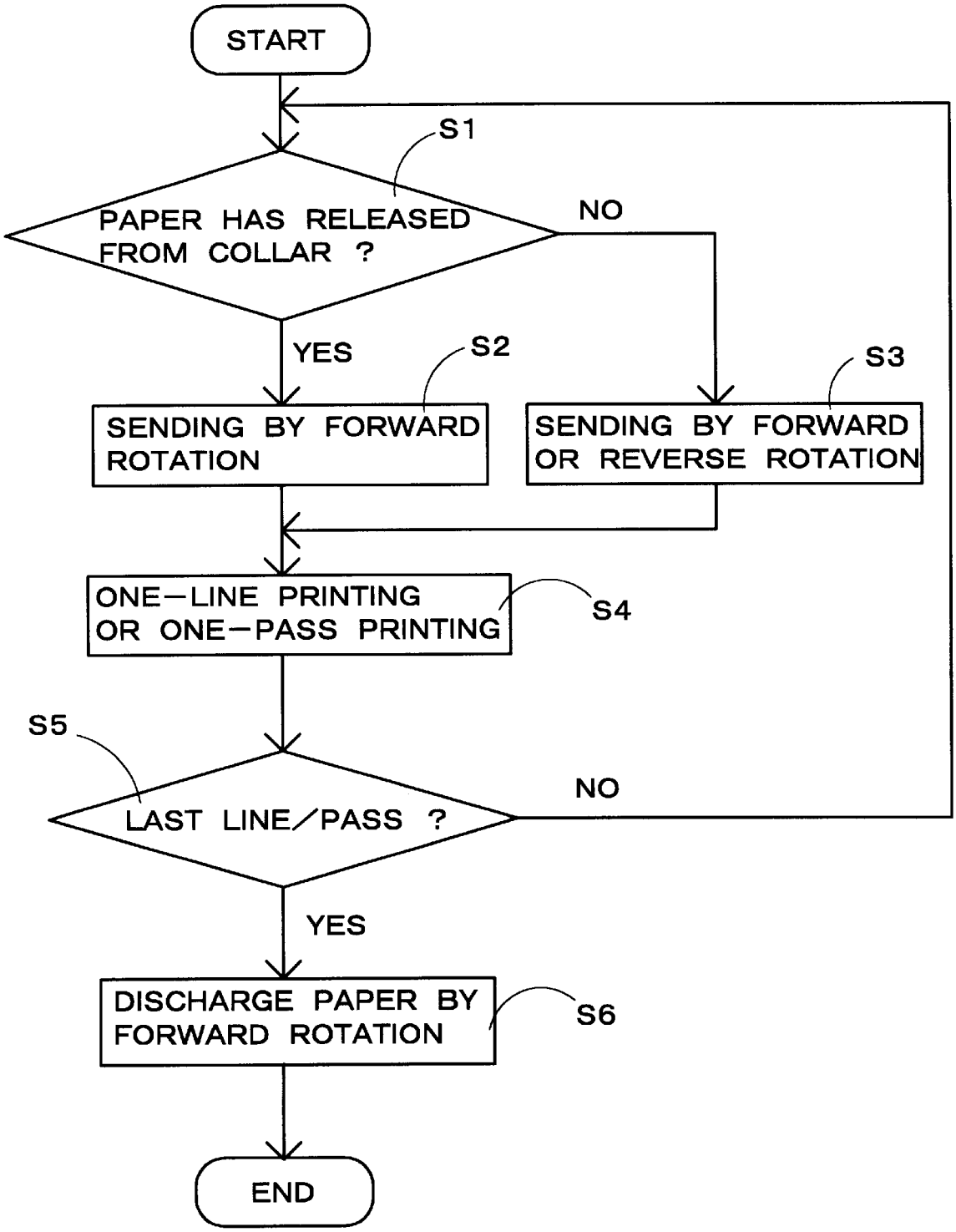
FIG. 3 is a flowchart of a program to control the rotation of a step motor in another embodiment according to the invention.

In the above embodiment, without regard to whether or not the paper end detecting sensor 141 has detected the back end of the paper sheet S (i.e., whether or not the collar 42 has released the paper sheet S), the step motor 75 is controlled to rotate counterclockwise by the first number of steps and then clockwise by the second number of steps every one-line printing conducted by the ink jet head 13. However, since the back-tension is substantially removed when the paper sheet S is released from the collar 42, it is not then necessary to control the step motor 75 to rotate by the second number of steps. For instance, the control of the step motor 75 can be conducted along a flowchart shown in FIG. 3. FIG. 3 is a flowchart of a program to control the rotation of the step motor 75.

In step (hereinafter, "S") 1, it is judged whether or not the paper end detecting sensor 141 has detected the back end of the paper sheet S, in other words, whether or not the paper sheet S has been released from the collar 42. When the paper sheet S has been released from the collar 42 (S1: YES), the back-tension having been removed, the step motor 75 is controlled to rotate only by the first number of steps without the rotation by the second number of steps (S2). When the paper sheet S is not released from the collar 42 (S1: NO), on the other hand, the back-tension being not removed, the step motor 75 is controlled to rotate by both the first number of steps and the second number of steps (S3) as well as in the above embodiment. After that, the ink jet head 13 performs the one-line printing or the one-pass of the interlace printing. In S5, it is judged whether there is printing data to thereby detect whether or not it is the last line or the last printing pass. When it is the last line or the last printing pass (S5: YES), the step motor 75 is controlled to rotate counterclockwise, discharging the paper sheet S from the ink jet printer P (S6). When it is not the last line nor the last print pass (S5: NO), alternatively, the flow returns to S1 to repeat the above processes.

For a driving power source of the pick-up roller 41 in the above embodiment, a dedicated driving motor may be used. Alternatively, the step motor 75 for driving the paper supply roller 70 may be used if a motion transmitting mechanism is disposed between the step motor 75 and the support shaft 40 of the pick-up roller 41, whereby any rotating motion based on the counterclockwise rotation of the step motor 75 is not transmitted to the support shaft 40, while only rotating motion based on the clockwise rotation of the step motor 75 by steps more than the predetermined number is transmitted to the support shaft 40, when the pick-up roller 41 is allowed to rotate clockwise. In this case, it is so constructed that the clockwise rotating motion of the step motor 75 will not be transmitted to the support shaft 40 until the step motor 75 is sequentially rotated clockwise by the number of steps larger than the second number of steps.

Accordingly, in an operation to pick up the paper sheet, when the step motor 75 is sequentially rotated clockwise by the number of steps more than the second number of steps, the pick-up roller 41 is rotated clockwise, thereby picking up the paper sheet. In addition, after the counterclockwise rotation by the first number of steps in a regular paper feeding operation, even if the step motor 75 is driven to rotate clockwise by the second number of steps to remove the back-tension, the pick-up roller 41 is not made to rotate by error.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A printing apparatus comprising:

a paper accommodating unit for accommodating stacked paper sheets;

a paper supply roller for feeding a paper sheet from the paper accommodating unit in a predetermined feeding direction;

a mechanism for generating tension in the paper sheet fed by the paper supply roller;

a driving motor for rotating the paper supply roller;

a print head for performing printing on the paper sheet fed by the paper supply roller; and a control unit for controlling the driving motor to rotate by a first rotation quantity in the feeding direction to feed the paper sheet and, after that, by a second rotation quantity which is smaller than the first rotation quantity in a reverse direction to said feeding direction to remove the tension generated in the paper sheet by the tension generating mechanism.

2. A printing apparatus according to claim 1, wherein said second rotation quantity of the driving motor is set to a rotation quantity whereby the tension can be removed.

3. A printing apparatus according to claim 2, wherein said print head performs line-printing every time when the paper sheet is fed by one line by the paper supply roller, or interlace printing where one-line printing is completed through a plurality of printing passes.

4. A printing apparatus according to claim 3, wherein said first rotation quantity of the driving motor is set to a rotation quantity obtained by adding the second rotation quantity to a rotation quantity corresponding to a paper feeding quantity of one line in the line-printing or another paper feeding quantity of each printing pass in the interlace printing performed by the print head.

5. A printing apparatus according to claim 4, wherein the control by the control unit to rotate the driving motor in accordance with the first rotation quantity and the second rotation quantity is made every line-printing operation or every printing operation of each printing pass in the interlace printing operation performed by the print head.

6. A printing apparatus according to claim 1, wherein said tension generating mechanism comprises a collar member which is supported rotatably above the paper accommodating unit and comes into contact with the paper sheet during the paper feeding by the paper supply roller.

7. A printing apparatus according to claim 6, further comprising means for detecting whether said collar member is released from the paper sheet, wherein the control unit controls the driving motor based on only the first rotation quantity when the detecting means detects that the collar member is released from the paper sheet.

8. A printing apparatus according to claim 7, wherein said detecting means comprises a sensor for detecting an end of the paper sheet when the paper sheet has just been released from the collar member.

9. A printing apparatus according to claim 1, wherein said print head is an ink jet head.

10. A printing apparatus comprising:

a hopper for accommodating stacked paper sheets;

a pick-up roller which comes into contact under pressure with a paper accommodated in the hopper to pick up the paper sheet;

a paper supply roller for feeding the paper sheet picked up by the pick-up roller in a predetermined feeding direction;

a tension generating mechanism for generating tension in the paper sheet fed by the paper supply roller;

a step motor for rotating the paper supply roller;

a print head for performing printing on the paper sheet fed by the paper supply roller; and a control unit for controlling the step motor to rotate by a first number of steps in the paper feeding direction to feed the paper sheet and, after that, to rotate by a second number of steps smaller than the first number of steps in a reverse direction to the paper feeding direction, thereby to remove the tension generated in the paper sheet by the tension generating mechanism.

* * * * *